US006708533B2

(12) United States Patent
Lavikainen et al.

(10) Patent No.: US 6,708,533 B2
(45) Date of Patent: Mar. 23, 2004

(54) PADLOCK ARRANGEMENT

(75) Inventors: Raimo Lavikainen, Lehmo (FI); Jarno Mertanen, Ylämylly (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 10/204,105

(22) PCT Filed: Feb. 27, 2001

(86) PCT No.: PCT/FI01/00198

§ 371 (c)(1),
(2), (4) Date: Sep. 10, 2002

(87) PCT Pub. No.: WO01/65036

PCT Pub. Date: Sep. 7, 2001

(65) Prior Publication Data

US 2003/0121295 A1 Jul. 3, 2003

(30) Foreign Application Priority Data

Feb. 29, 2000 (FI) ..... 2000457

(51) Int. Cl.[7] ..... E05B 67/22

(52) U.S. Cl. ..... 70/38 A; 70/367; 70/54; 70/417

(58) Field of Search ..... 70/38 A, 39, 52–56, 70/367–371, 416, 417

(56) References Cited

U.S. PATENT DOCUMENTS

| | | | | |
|---|---|---|---|---|
| 2,834,195 A | | 5/1958 | Stackhouse | 70/339 |
| 3,800,570 A | * | 4/1974 | Kaplan | 70/54 X |
| 4,112,715 A | | 9/1978 | Uyeda | 70/38 A |
| 4,132,092 A | * | 1/1979 | Steinbach | 70/417 X |
| 4,138,868 A | | 2/1979 | Richards, Sr. | 70/38 A |
| 4,180,996 A | | 1/1980 | Lebrecht | 70/52 |
| 4,290,279 A | | 9/1981 | Fish et al. | 70/38 A |
| 4,464,915 A | | 8/1984 | Moshe et al. | 70/52 |
| 4,530,223 A | * | 7/1985 | Oliver | 70/417 |
| 4,545,223 A | | 10/1985 | Poutiainen et al. | 70/38 A |
| 5,174,136 A | * | 12/1992 | Thwing | 70/38 A |
| 5,186,029 A | * | 2/1993 | Myers | 70/38 A |
| 5,233,851 A | | 8/1993 | Florian | 70/367 |
| 5,572,890 A | * | 11/1996 | Carpenter | 70/371 |
| 5,730,008 A | * | 3/1998 | Case et al. | 70/53 X |
| 5,921,116 A | * | 7/1999 | Goldenberg | 70/18 |
| 6,240,754 B1 | * | 6/2001 | Petersen | 70/417 |

FOREIGN PATENT DOCUMENTS

| | | |
|---|---|---|
| GB | 2 216 944 | 10/1989 |

* cited by examiner

*Primary Examiner*—Suzanne Dino Barrett
(74) *Attorney, Agent, or Firm*—John Smith-Hill; Smith-Hill and Bedell

(57) ABSTRACT

A padlock including a lock body (1), a lock shackle (2) movable between locking and releasing positions, and, inside the lock body, bolt means (5) for securing and releasing the shackle (2) in its locking position, and a cylinder lock mechanism (3) for controlling the bolt means (5). The cylinder lock mechanism (3) is replaceably mounted in a separate casing-like fixing unit (6), which is detachably fixed to the lock body, (1). The fixing unit (6) has inner guiding surfaces (6*c*), which correspond to the outer shape of the cylinder lock mechanism (3, 3', 3"), to provide both radial and axial support for the cylinder lock mechanism (3, 3', 3").

9 Claims, 2 Drawing Sheets

PADLOCK ARRANGEMENT

TECHNICAL FIELD

This invention relates to a padlock of the kind comprising a lock body, a lock shackle movable between locking and releasing positions, and, inside the lock body, bolt means for securing and releasing the shackle in its locking position and a cylinder lock mechanism for controlling the bolt means.

BACKGROUND OF THE INVENTION

Padlocks are produced in different sizes and forms and can be equipped with different kinds of lock shackles depending on their intended use and required strength properties. Generally each lock manufacturer produces its own lock bodies and lock mechanisms designed for particular uses. Different manufacturers have cylinder locks of different sizes and forms depending on the traditions of lock manufacturers and the practice and norms of different marketing areas. Because of these factors it has not generally been possible to use, for a given design of lock body, different cylinder lock mechanisms providing a series of padlocks of similar appearance but having different intended uses or different geographical areas of use. Instead each manufacturer generally produces a different padlock body for each cylinder lock type.

Padlocks of the kind referred to and having replaceable lock mechanisms are known from U.S. Pat. No. 3,835,675 and U.S. Pat. No. 4,545,223. Such known padlocks can be operated with different keys by changing the opening combination of the lock mechanism, for example by replacing the whole cylinder lock with another similar type.

DISCLOSURE OF THE INVENTION

One aim the present invention is to simplify the production and assembly of padlocks so that the same padlock body can be used for different kinds of cylinder lock types. In this way norms and practices of different countries can be taken account of in a better and simpler manner than before whilst allowing the benefits of mass-production to be achieved. It is also an aim of the invention to provide a padlock having improved burglarproof features.

With a padlock embodying the present invention it is possible to make use of the same lock body with different cylinder lock types. Additionally, due to its casing-like construction, the fixing unit protects the cylinder lock mechanism better than other known releasable cover elements.

It is possible to choose according to the requirement of the padlock the material from which the fixing unit is made. Advantageously the material chosen for the fixing unit will be different from the material of the lock body and/or the cylinder lock mechanism. For example the fixing unit may be made from chilled steel. In this the cylinder lock mechanism itself, or particularly its cylinder and other locking device parts, can be fabricated from cheaper material, without sacrificing the burglarproof properties of the padlock. The same applies also to the padlock body itself which can be made, for example, from brass if the intended use does not require the padlock to be made of steel.

If the guiding surfaces of the fixing unit are formed so that they guide two or several different kinds of cylinder lock mechanisms, the same fixing unit can be used correspondingly for different kinds of lock cylinder mechanisms. In this manner the amount of different stock items can be reduced.

The fixing unit is most favourably formed so that its dimension in a plane perpendicular to the axial direction of the cylinder lock mechanism is essentially greater than its dimension in this axial direction. In this case it can be equipped in practically all issued cylinder lock types, for example with tumbler locks or so called DIN-norm locks and despite of that the basic form of the padlock can be held quite flat.

The fixing unit is able to support different types of lock mechanism. Thus many different types of padlock, each having the same lock body, can be created. Also by providing different fixing units, whose inner guiding surfaces are different and which support different lock mechanisms, even more padlock types can be created for the same lock body.

According to another aspect of the invention there is provided a padlock arrangement as claimed in the ensuing claim 6.

BRIEF DESCRIPTION OF THE DRAWINGS

Embodiments of the invention will now be described, by way of example only, with particular reference to the accompanying drawings, in which.

MODES FOR CARRYING OUT THE INVENTION

Figure 1:
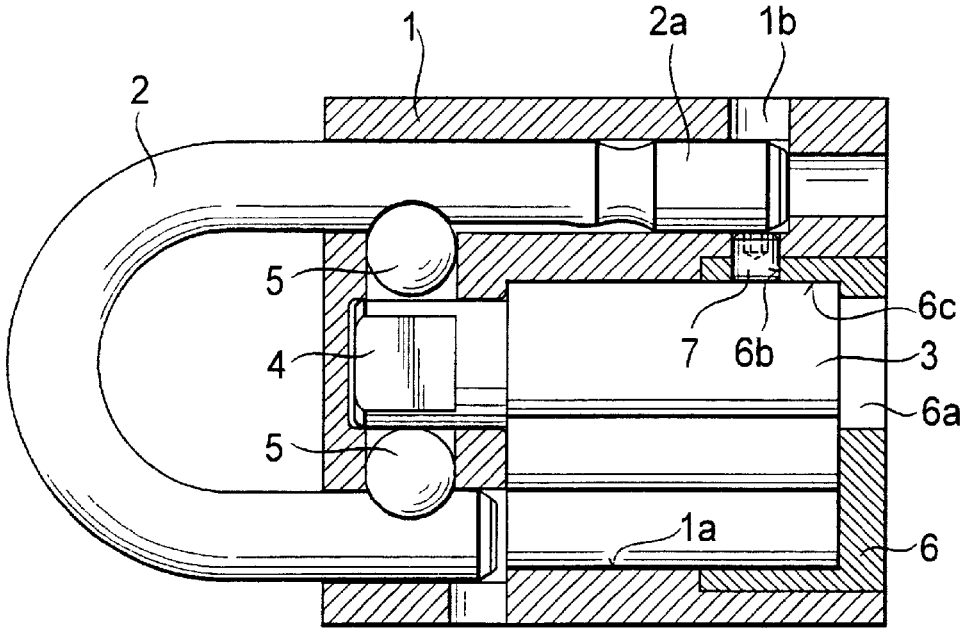
FIG. 1 is a sectional view of one embodiment of a padlock according to the invention.

FIGS. 1 shows a padlock having a lock body 1 in which is received a cylinder lock mechanism 3 and a generally U-shaped lock shackle 2 having a pair of different length legs. The legs are received in bores formed in the lock body 1 and the lock shackle 2 is movable between a locked position (shown in FIG. 1) and a free or releasing position. In the locked position of the shackle 2, bolt means 5, in the form of spherical locking members, are received in notches formed in the legs of the shackle. In the releasing position (not shown), the shorter leg is moved out of its bore in the lock body 1 and the bolt means engages in an annular recess formed in the longer leg of the shackle. In this releasing position the shackle can be turned about the longitudinal axis of the longer shackle leg so that the longer shackle leg turns within the bore of the lock body in which it is received. A turnable torsion device 4 turned by or under the control of the lock mechanism 3 controls the operation of the bolt means 5 in a known manner.

The cylinder lock mechanism 3 is mounted within, and retained fast within, the lock body 1 using a fixing unit 6 which also covers the cylinder lock mechanism 3 in its installed position within the lock body. The fixing unit 6 has a key opening 6*a* for a key to operate the cylinder lock mechanism 3 and an opening 6*b* for fastening the fixing unit 6 to the lock body 1 with a screw threaded bolt 7 or the like. The bolt 7 can be accessed for securing or releasing the fixing unit to or from the lock body 1 by means of a tool (not shown) insertable into an opening 1*b* of the lock body. The bolt 7 can only be accessed after the cylinder lock mechanism 3 is opened with the key of the lock and the lock shackle 2 moved out of its locking position, e.g. into its releasing position so that the longer leg 2*a* of the shackle 2 does not prevent access to the bolt.

Figure 2:
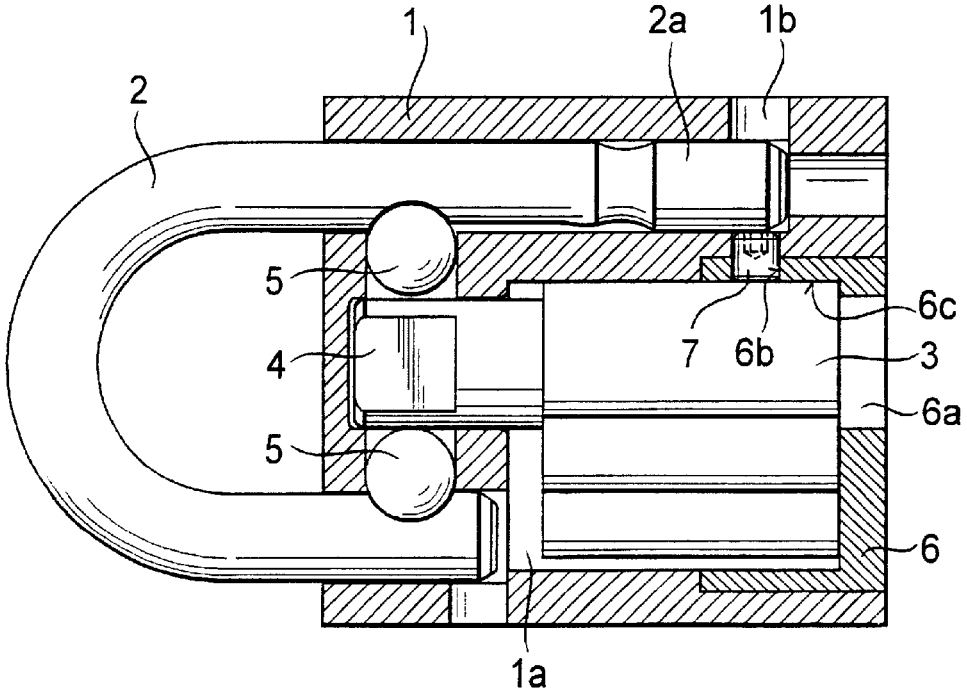
FIG. 2 is a sectional view of another embodiment of a padlock according to the invention.

As can be seen from FIGS. 1 and 2, the padlock has a key cylinder 1 *a* which is able to receive and accommodate different sizes, forms of cylinder lock mechanisms 3. The different lengths of the cylinder in the axial direction can be easily accommodated by suitable dimensioning of the torsion device 4. The cylinder lock mechanism 3 remains between the inner surface of the key cylinder 1*a* and the inner surface of the fixing unit and accordingly receives its axial direction guidance from these surfaces. The radial direction guidance of the cylinder lock mechanism 3 is accomplished by forming the inner surfaces 6*c* of the fixing unit 6 suitably for outer forms of each cylinder lock mechanisms 3. How this is achieved in this case where the cylinder lock mechanism is distinctly smaller than the key cylinder 1*a* itself is shown in FIG. 2.

Figure 3:
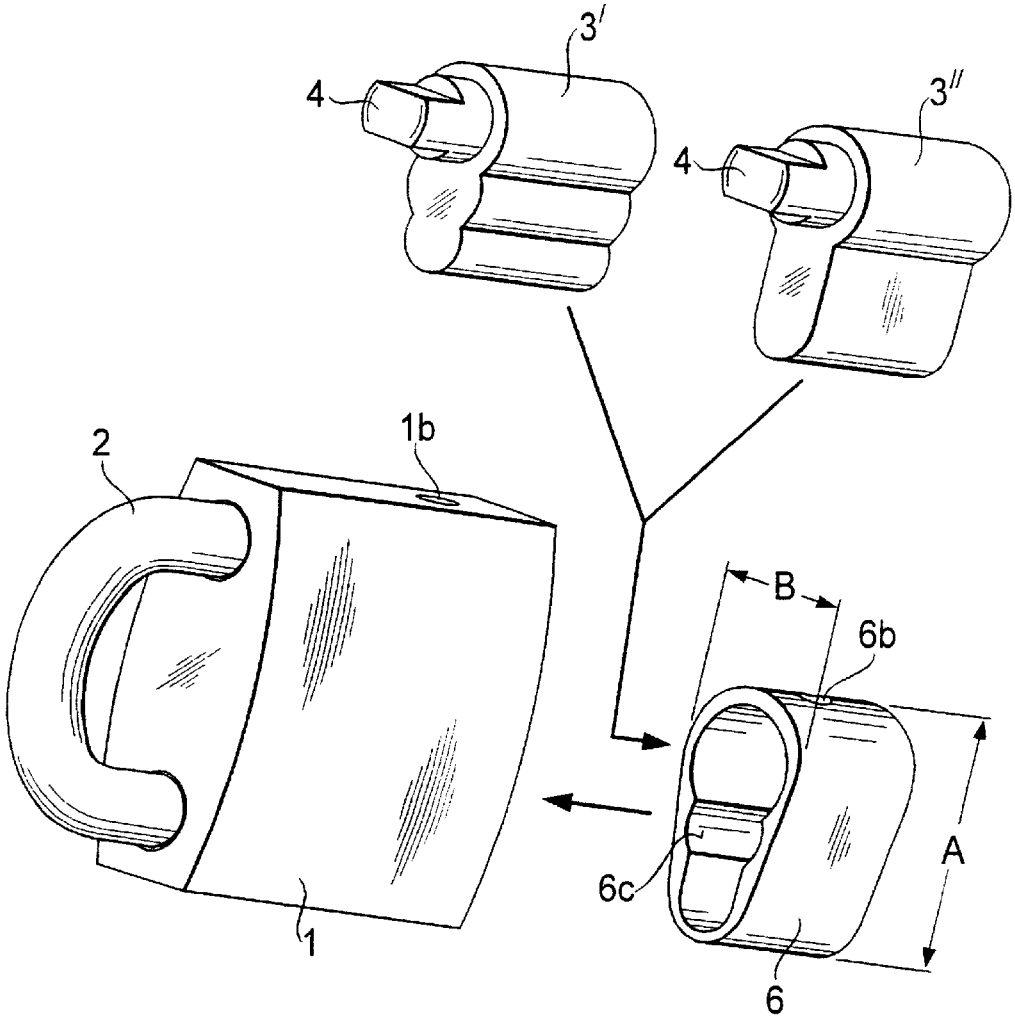
FIG. 3 is a perspective view illustrating a partly assembled padlock arrangement comprising a lock body, a fixing unit and two different lock mechanisms which can be selectively mounted in the lock body to create different types of padlock.

FIG. 3 illustrates a padlock arrangement for enabling two different cylinder lock mechanisms 3' and 3" to be selectively, replaceably received within the lock body 1 using a single fixing unit 6. In particular the inner surfaces 6*c* of the fixing unit are so formed that they provide axial and radial support for the selected lock mechanism. As can be seen in FIG. 3, the inner surfaces 6*c* are preferably of generally cylindrical form for receiving correspondingly shaped external surfaces of the cylinder lock mechanisms. Although two lock mechanisms 3' and 3" are shown in the padlock arrangement of FIG. 3, it will be appreciated that more than two different lock mechanisms can be provided so that several different padlocks can be created having the same lock body 1.

Because especially in so called tumbler based cylinder locks the dimension of pins' motional direction is greater, it is advantageous for the analogous dimension A of the fixing unit to be substantially greater than the dimension B transverse to it (see FIG. 3). This secures the applicability of the fixing unit 6 for cylinder lock mechanisms with different operating principles which can be assembled in the same lock body 1.

If necessary the arrangement can advantageously include several different fixing units 6, which differ from each other in the design of their inner surfaces. This allows lock mechanisms having differently shaped and/or dimensioned outer surface to be mounted in different fixing units but with the same lock body 1.

The invention is not limited to the embodiments shown but several modifications of the invention are reasonable within the scope of the attached claims.

What is claimed is:

1. A padlock comprising:

a lock body that defines a chamber bounded by an inner peripheral surface of the lock body, a fixing unit that is located in the chamber of the lock body and has an outer peripheral surface that substantially matches the inner peripheral surface of the lock body, the fixing unit being detachably fixed to the lock body and defining a cavity that is substantially completely laterally bounded by lateral guiding surfaces and is axially bounded by an end surface, a lock shackle mounted in the lock body and movable relative to the lock body between a locking position and a releasing position, a bolt element in the lock body for selectively securing and releasing the lock shackle in its locking position, and a cylinder lock mechanism for controlling the bolt element, the cylinder lock mechanism being located at least partially in the cavity of the fixing unit and substantially completely surrounded laterally by the lateral guiding surfaces of the fixing unit, the lock mechanism having an end surface that is presented towards the end surface of the fixing unit and having lateral surfaces that are presented towards the lateral guiding surfaces of the fixing unit, whereby the fixing unit provides both axial and radial support for the lock mechanism.

2. A padlock according to claim 1, wherein the fixing unit is fabricated from a different material from that of the lock body.

3. A padlock according to claim 1, wherein the fixing unit is fabricated from a different material from the cylinder lock mechanism.

4. A padlock according to claim 1, wherein the fixing unit is made from chilled steel.

5. A padlock according to claim 1, wherein the cylinder lock mechanism has an axial direction, the fixing unit has first and second mutually perpendicular linear dimensions in a plane perpendicular to said axial direction, said first dimension is a maximum linear dimension of the fixing unit in said plane, and said first dimension is greater than said second dimension.

6. A padlock according to claim 1, wherein the cylinder lock mechanism includes a torsion element that is turnable about a central axis thereof, the fixing unit has first and second mutually perpendicular linear dimensions in a plane perpendicular to said central axis, said first dimension is a maximum linear dimension of the fixing unit in said plane, and said first dimension is greater than said second dimension.

7. A padlock according to claim 1, wherein the cylinder lock mechanism includes a torsion element that is turnable about a central axis thereof, the chamber of the lock body is longer than the fixing unit in the axial direction of the torsion element, and the fixing unit is removable from the chamber.

8. A padlock according to claim 1, wherein the lateral surfaces of the cylinder lock mechanism include a first lateral surface portion that engages a corresponding lateral guiding surface portion of the fixing unit and also include a second lateral surface portion that is spaced from the lateral guiding surfaces of the fixing unit.

9. A padlock according to claim 1, wherein the lock body has first and second opposite end surfaces and is formed at its first end surface with two parallel bores for receiving respective legs of the shackle and is formed at the second end surface with an opening for providing access to the chamber, and the fixing unit is located in said opening and is removable from the cavity by way of the opening when detached from the lock body.

* * * * *